US008935884B2

(12) United States Patent
Pang et al.

(10) Patent No.: US 8,935,884 B2
(45) Date of Patent: Jan. 20, 2015

(54) ARRANGEMENT FOR CLOSING AN OPENING FOR THE OUTPUT AND/OR INPUT OF NOTES OF AN AUTOMATED TELLER MACHINE

(75) Inventors: Tee Meng Pang, Singapore (SG); Hengky Wirawan, Singapore (SG)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 13/806,037

(22) PCT Filed: Jun. 22, 2011

(86) PCT No.: PCT/EP2011/060436

§ 371 (c)(1),
(2), (4) Date: Feb. 5, 2013

(87) PCT Pub. No.: WO2011/161154

PCT Pub. Date: Dec. 29, 2011

(65) Prior Publication Data

US 2013/0152475 A1 Jun. 20, 2013

(30) Foreign Application Priority Data

Jun. 22, 2010 (EP) ..... 10401086

(51) Int. Cl.

| | |
|---|---|
| ***E05F 15/02*** | (2006.01) |
| ***E05F 15/10*** | (2006.01) |
| ***G07F 19/00*** | (2006.01) |

(Continued)

(52) U.S. Cl.

CPC ..... *G07F 19/205* (2013.01); *G07D 11/0018* (2013.01); *G07F 19/20* (2013.01); *G07D 11/0003* (2013.01); *H01F 7/145* (2013.01)

USPC ..... 49/340; 49/339; 49/41; 49/324

(58) Field of Classification Search

USPC ..... 49/74.1, 79.1, 82.1, 324, 340, 339, 41; 109/44; 16/319; 454/217, 221, 224, 454/278

See application file for complete search history.

(56) References Cited

U.S. PATENT DOCUMENTS 3,229,171 A * 1/1966 Daugherty ..... 335/272
4,063,520 A * 12/1977 Parsons ..... 109/66

(Continued)

FOREIGN PATENT DOCUMENTS

EP 0766210 A2 4/1997
EP 0780785 A2 6/1997

(Continued)

OTHER PUBLICATIONS

International Search Report and Written Opinion (Both in English) for PCT/EP2011/060436, mailed Aug. 25, 2011; ISA/EP.

*Primary Examiner* — Katherine Mitchell
*Assistant Examiner* — Shiref Mekhaeil
(74) *Attorney, Agent, or Firm* — Harness, Dickey & Pierce, P.L.C.

(57) ABSTRACT

The invention relates to an arrangement (10) for closing an opening for the input and/or output of notes of a device for handling notes. The arrangement (10) comprises a pivotable shutter element and a rotary solenoid. An armature of the rotary solenoid is connected to the shutter element via a connecting element. In a first position of the armature the shutter element is arranged in a closed position, and in a second position of the armature the shutter element is arranged in an open position.

10 Claims, 5 Drawing Sheets

(51) Int. Cl.
*G07D 11/00* (2006.01)
*H01F 7/14* (2006.01)

(56) References Cited

U.S. PATENT DOCUMENTS 4,176,610 A * 12/1979 Markham et al. ..... 109/59 R
4,848,873 A * 7/1989 Villar ..... 359/230
5,079,498 A * 1/1992 Cleasby et al. ..... 323/283
5,172,643 A * 12/1992 Koshida et al. ..... 109/10
5,584,098 A * 12/1996 Koyama et al. ..... 16/441
6,131,336 A * 10/2000 Krause et al. ..... 49/74.1
6,227,635 B1 * 5/2001 Teppo et al. ..... 312/328
6,471,312 B1 * 10/2002 Coffey et al. ..... 312/328
6,780,098 B2 * 8/2004 Nishida et al. ..... 454/155
6,881,139 B2 * 4/2005 Yang ..... 454/155
6,974,377 B2 * 12/2005 Gehring et al. ..... 454/152
7,575,510 B2 * 8/2009 Kim ..... 454/155
2010/0200610 A1 * 8/2010 Landers et al. ..... 222/1

FOREIGN PATENT DOCUMENTS

EP 0766210 B1 11/2002
JP 8-138930 A 5/1996
JP 2008-188057 A 8/2008
WO WO-2008-111148 A1 9/2008

* cited by examiner

ARRANGEMENT FOR CLOSING AN OPENING FOR THE OUTPUT AND/OR INPUT OF NOTES OF AN AUTOMATED TELLER MACHINE

CROSS-REFERENCE TO RELATED APPLICATIONS

This application is a National Stage of International Application No. PCT/EP2011/060436, filed Jun. 22, 2011, and published in English as WO 2011/161154 A1 on Dec. 29, 2011. This application claims the benefit and priority of European Application No. 10401086.3, filed Jun. 22, 2010. The entire disclosures of the above applications are incorporated herein by reference.

BACKGROUND

This section provides background information related to the present disclosure which is not necessarily prior art.

1. Technical Field

The invention relates to an arrangement for closing an opening for the input and/or output of notes of a device for handling notes. The arrangement comprises a shutter element which is mounted so as to be pivotable about an axis and which, in a closed position, closes the opening and, in an open position, enables the output or input of notes through the opening.

2. Discussion

From the document EP 0 766 210 B1, a closure-shutter arrangement for the access opening of an automated teller machine is known, which comprises a shutter for closing the access opening. The shutter is driven via a drive motor which adjusts the shutter via at least one cam body, which is connected in a rotationally fixed manner to a drive shaft, and a cam follower, which is connected to the shutter lever. Further, a closing hook and a hook-in element are provided for locking the shutter in its closed position. What is problematic with this closure-shutter arrangement is that, on the one hand, it is designed in a relatively complicated manner and is thus expensive and, on the other hand, it requires a large installation space.

SUMMARY OF THE INVENTION

It is an object of the invention to specify an arrangement for closing an opening for the output and/or input of notes of a device for handling notes, which arrangement is simply and compactly constructed.

By providing a rotary solenoid having an armature which is rotatable about its longitudinal axis and which is connected to the shutter element via a connecting element, it is achieved that the shutter element can easily be brought from a closed position into an open position and vice versa in that the armature is moved from a first position into a second position or, respectively, from the second position into the first position. By moving the shutter element with the aid of the rotary solenoid, a simple, compact and cost-efficient structure of the arrangement is achieved. Compared to drive motors, such rotary solenoids are cheap. Further, only a simply structured connecting element for connecting the rotary solenoid to the shutter element is required so that complicated coupling devices can be dispensed with.

The device for handling notes is in particular an automated teller machine, an automatic cash system and/or an automatic cash safe. An automated teller machine can be a mere deposit machine in which notes of value are merely input through the opening, a mere withdrawal machine in which notes of value are merely output through the opening, or a recycling automated teller machine in which notes of value are both input and output through the opening. The notes can be banknotes or checks. The armature of the rotary solenoid is only pivotable in a limited angular range which is smaller than 360°.

In the second position, the armature is rotated preferably by a preset angle, in particular an angle between 60° and 70°, about its longitudinal axis relative to the first position. Hereby it is achieved that for moving the shutter element from the open position into the closed position or vice versa, the armature only has to be rotated by a small angle so that a moving is easily possible.

The rotary solenoid is preferably de-energized in the first position and energized in the second position. Hereby it is achieved that in the possible event of a failure of a power supply to the rotary solenoid the shutter element remains in the closed position, and that the shutter element will not remain in the open position or will be moved into the open position in the case of a power failure, as it would be the case if the armature were de-energized in the first position and energized in the second position. Hereby it is achieved that an unauthorized access to the opening, in particular to notes present in the opening, is prevented. Further, attempts of manipulation at the automated teller machine are hereby made more difficult.

The rotary solenoid comprises in particular an elastic element which holds the armature in the first position and which is elastically deformed when the armature is arranged in the second position. By means of the elastic element the armature is automatically moved from the open position into the closed position when the rotary solenoid is turned off and thus de-energized. In the movement from the open into the closed position the elastic element is further assisted by the gravity of the shutter element. In particular a spring is used as an elastic element. Hereby, a simple and cost-efficient structure is achieved.

The connecting element is in particular designed in the form of a plate so that a slim simple structure is achieved.

In a preferred embodiment of the invention a first end region of the connecting element is rotatably connected to the armature and a second end region opposite to the first end region is rotatably connected to the shutter element. The first end region is in particular connected via a first mounting element to the armature so as to be rotatable relative to the armature about a first axis of rotation and the second end region is in particular connected via a second mounting element to the shutter element so as to be rotatable relative to the shutter element about a second axis of rotation. The first axis of rotation preferably coincides with the center axis of the first mounting element and/or the second axis of rotation coincides with the center axis of the second mounting element.

Hereby, a simple connection between the armature of the rotary solenoid and the shutter element is achieved via the connecting element. By the respective rotatable connection between the connecting element and the armature and the respective rotatable connection between the connecting element and the shutter element, it is possible that, as a result of the rotary motion of the armature of the rotary solenoid, a pivot motion of the shutter element about the axis is created.

In a particularly preferred embodiment of the invention a first connecting line, which orthogonally intersects both the first axis of rotation and the center axis of the armature, and a second connecting line, which orthogonally intersects both the first axis of rotation and the second axis of rotation, intersect one another at an angle between 0° and 180°. In a particularly preferred embodiment of the invention, the first and the second connecting lines intersect one another at an angle between 90° and 179°. The before-mentioned angle values each time refer to the arrangement of the armature in the first position.

Further, it is advantageous when a third connecting line which orthogonally intersects both the second axis of rotation and the axis, about which the shutter element is pivotable, and the second connecting line intersect one another at an angle between 90° and 180°, in particular between 91° and 135°, when the armature is arranged in the first position.

The arrangement in particular comprises a first stop element which contacts the connecting element and prevents a rotary motion of a connecting element in a first direction of rotation when the armature is arranged in the first position, and/or a second stop element which contacts the shutter element and prevents a rotary motion of the shutter element in a second direction of rotation when the armature is arranged in the first position. By the provision of the two stop elements as well as the intersection of the first connecting line and the second connecting line at an angle of less than 180° and of the second and third connecting line at an angle of greater than 90° it is achieved that the shutter element is automatically locked when it is arranged in the closed position. The shutter element can thus not be opened externally since the rotary motions of the connecting element and of the armature required for the external opening are prevented as a result of the respective arrangement at the angles indicated and the stop elements. Hereby it is achieved that no additional locking mechanism is required, as a result whereof, on the one hand, a simple and cost-efficient structure is achieved and, on the other hand, an unintentional forgetting of the locking is prevented.

The first direction of rotation and the second direction of rotation in particular have opposite senses of rotation. Thus, for example, the connecting element cannot be rotated anti-clockwise because of the first stop element, and the shutter element cannot be rotated clockwise because of the second stop element.

Further, it is advantageous when the arrangement comprises a control unit which controls the rotary solenoid. The control unit controls in particular the application of electric current to the rotary solenoid. It is particularly advantageous when the control unit controls the electric current (DC power) applied to the rotary solenoid in the form of a pulse width modulation (PWM). Hereby it is achieved that when the shutter element is arranged in the open position only the current which is minimally required for this flows, and thus an overheating of the rotary solenoid is prevented. To open the shutter element the rotary solenoid can be controlled by the control unit by applying a permanent DC current without pulses. Alternatively, another pulse width than in the open position can be applied in such a way that to open the shutter more electrical power is applied to the rotary solenoid than to hold the shutter in its open position.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which explains the invention with reference to embodiments in connection with the enclosed Figures.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
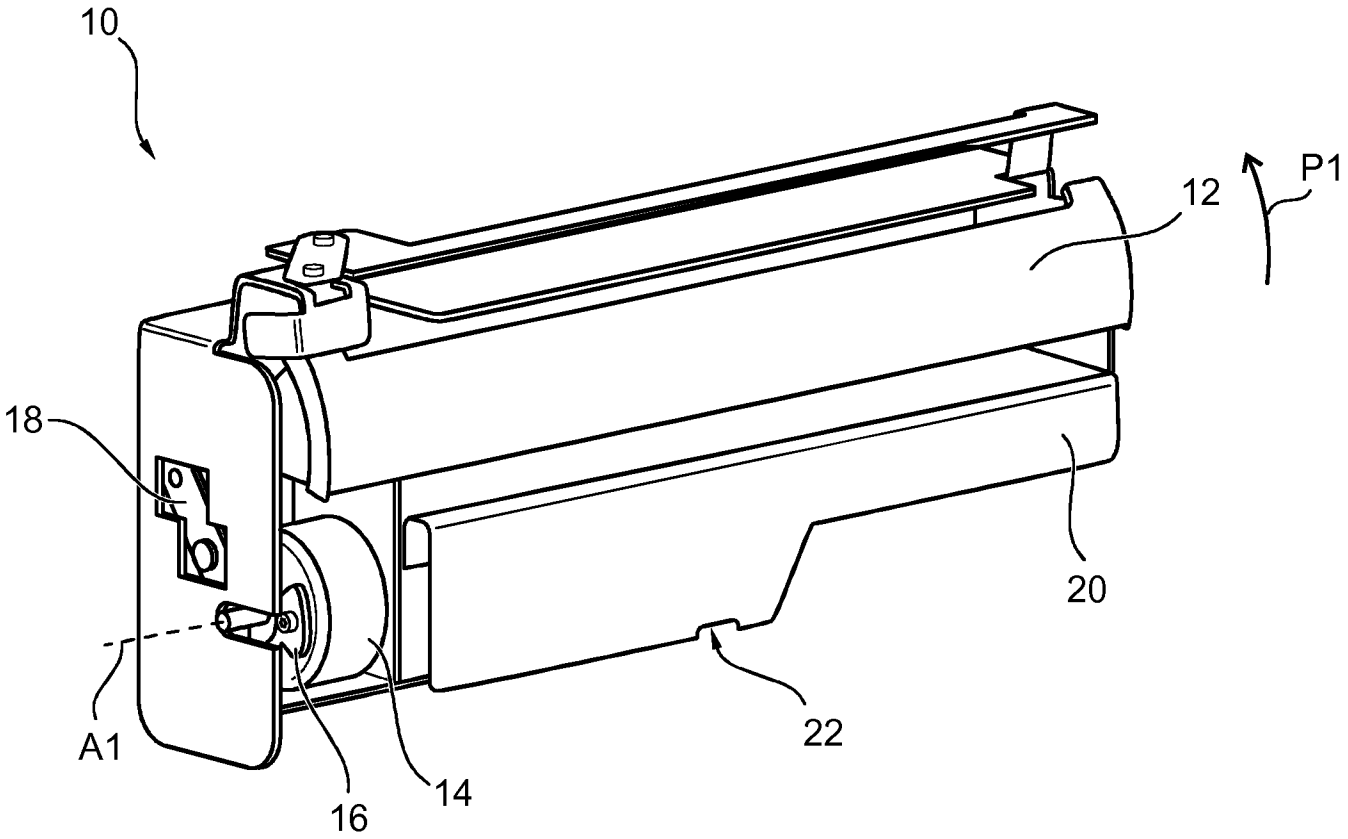
FIG. 1 is a schematic perspective illustration of an arrangement for closing an opening for the output and/or input of notes.

In FIG. 1, a schematic perspective illustration of an arrangement for closing an opening for the input and/or output of notes of a device for handling notes is shown. The device itself is not illustrated. The device for handling notes of value can be an automated teller machine, an automatic cash system or an automatic cash safe from which notes can be dispensed and/or in which notes can be deposited. The input and/or output of the notes takes place via an opening of an input and/or output unit of the device, wherein this opening can be closed and opened by means of the following arrangement which is described in more detail.

The most important requirements for such an arrangement 10 for closing the opening for the input and/or output of notes are as follows:

In a closed position, the arrangement 10 shall reliably close the opening so that an unauthorized access to the opening closed by the arrangement 10 is not possible. In particular, the arrangement 10 must not be manually actuatable by external people but has to be reliably locked.

In addition the arrangement 10 shall be designed as compact and simple as possible in order to optimally utilize the limited installation space in the device for handling notes. Further, by means of a simple structure of the arrangement 10 a cost-efficient production of the arrangement 10 is made possible.

Moreover, it is important that an operating person of the device is not injured by the arrangement 10 when the opening is closed.

These objects are easily solved by the following arrangement 10 which is described in detail:

The arrangement 10 comprises a shutter element 12 which, in a closed position, closes the opening for the input and/or output of notes and, in an open position, enables access to the opening for the output and/or input of notes.

Further, the arrangement 10 comprises a rotary solenoid 14. The armature 16 of the rotary solenoid 14 is rotated about its longitudinal axis A1 when the rotary solenoid 14 is actuated. The armature 16 is connected to the shutter element 12 via a connecting element 18. By a movement of the armature 16 from a first position into a second position, through the connection via the connecting element 18, the shutter element 12 is pivoted about an axis A2 from the closed position into the open position or, vice versa, when the armature 16 is moved from the second position into the first position the shutter element 12 is moved from the open position into the closed position.

In addition, the arrangement 10 has a plurality of housing parts, of which one is exemplarily identified with the reference sign 20. The shutter element 12 and the rotary solenoid 14 are mounted on the housing 20. Further, the housing parts 20 serve to limit the opening.

The rotary solenoid 14 is, as will be described in more detail in the following, controlled via a control unit 22. The control unit 22 in particular controls the current which is applied to the rotary solenoid 14.

Figure 2:
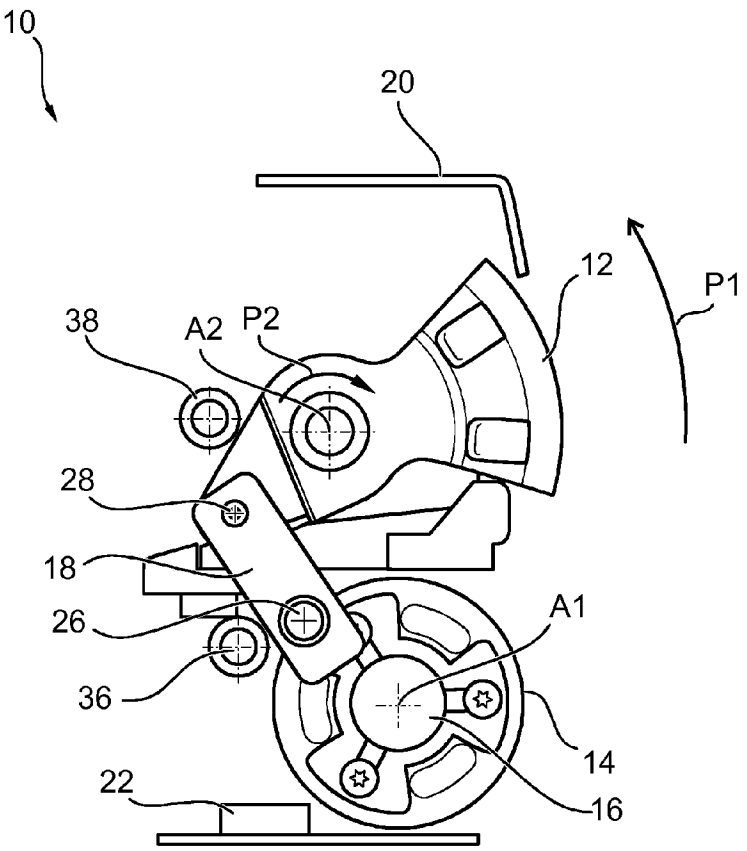
FIG. 2 is a schematic simplified side view of the arrangement according to FIG. 1 in a closed position of a shutter element.

In FIG. 2 a simplified side view of the arrangement 10 according to FIG. 1 is shown. The shutter element 12 is in the closed position, and the armature 16 of the rotary solenoid 14 is in the first position.

Figure 3:
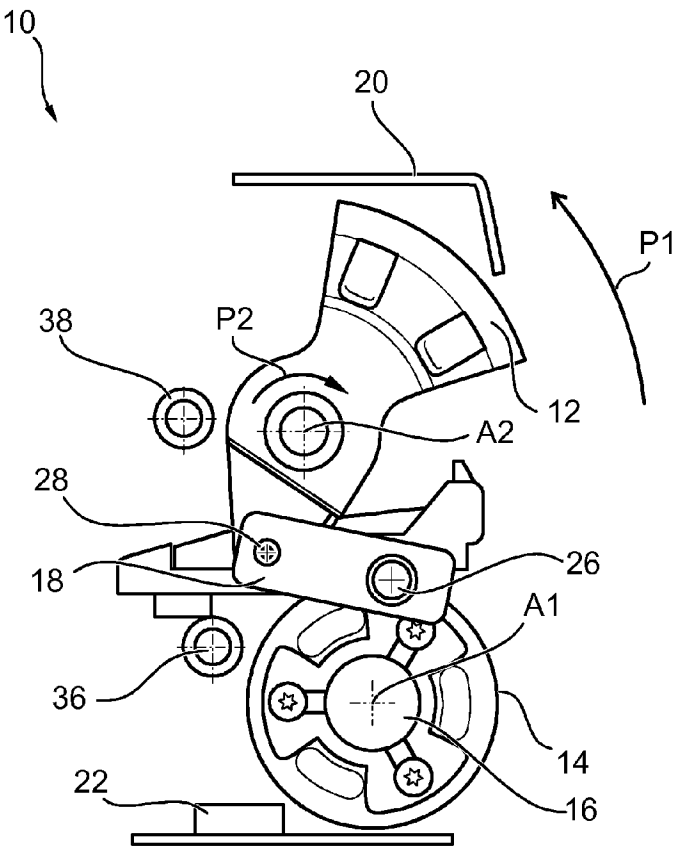
FIG. 3 is a schematic simplified side view of the arrangement according to FIGS. 1 and 2 when the shutter element is in an open position.

In FIG. 3 a side view of the arrangement 10 according to FIGS. 1 and 2 is shown, the shutter element 12 being arranged in the open position and the armature 16 being arranged in the second position. In the second position, the armature 16 is clockwise rotated by a preset angle in the direction of the arrow P1 relative to the first position according to FIG. 2. In particular, this angle has a value in the range between 50° and 70°.

A first end region of the connecting element 18 is connected to the armature 16 via a screw 26 in a manner so as to be rotatable relative to the armature 16 and so as to be stationary relative to the armature 16. When moving the armature 16 from the first position into the second position, the connecting element 18 is likewise moved in the direction of the arrow P1.

A second end region of the connecting element 18 opposite to the first end region is connected via a second screw 28 to the shutter element 12 so as to be rotatable relative to the shutter element 12 and so as to be stationary relative to the shutter element 12. When the armature 16 is moved from the first into the second position and by moving the connecting element 18, the shutter element 12 is counterclockwise pivoted about the axis A2 via the connection between the second end region and the shutter element 12 and thus moved from the closed into the open position.

The first position of the armature 16 is in particular the position assumed by the armature 16 when the rotary solenoid 14 is de-energized, i.e. no electrical power is applied thereto. If electrical power is applied to the rotary solenoid 14, the armature 16 is moved from the first position into the second position. Thus, the rotary solenoid 14 is energized when the armature 16 is arranged in the second position and the shutter element 12 is arranged in the open position.

In an alternative embodiment of the invention, the rotary solenoid 14 can also be energized when the shutter element 12 is closed, and the rotary solenoid 14 can be de-energized when the shutter element 12 is arranged in the open position. By arranging the shutter element 12 in the closed position when the rotary solenoid 14 is de-energized it is achieved that in the case of a possible event of a power failure the shutter element 12 is automatically moved into the closed position so that an access to the opening which can be closed by the shutter element 12 is not possible. Thus attempts of manipulation are prevented.

The control unit 22 applies the necessary electrical power to the rotary solenoid 14 in particular in the form of a pulse width modulation. Hereby it is achieved that an overheating of the rotary solenoid 14, in particular a melting of the isolation of the windings of the coil of the rotary solenoid 14 is prevented. In an alternative embodiment of the invention, the control unit 22 can also control the rotary solenoid 14 such that a constant current is applied to it when it is energized.

Further, the rotary solenoid 14 comprises a non-illustrated spring which holds the armature 16 in the first position. When the armature is moved in the direction P1 into the second position then the spring is pretensioned against its spring force. The force required for this is applied via the rotary solenoid 14. When no more electrical power is applied to the rotary solenoid 14, the armature 16 is moved from the second position into the first position by the spring so that the shutter element 12 is moved from the open position into the closed position. Further, upon closing the shutter element 12, this is assisted by the gravity of the shutter element 12. In this way, a quick reliable closing of the shutter element 12 is achieved. What is further achieved hereby is that it is avoided that the shutter element 12 is unintentionally left open.

In an alternative embodiment of the invention, another elastic element can likewise be used instead of the spring, for in instance a polymer block. Further, it is alternatively possible that the spring and/or another elastic element are arranged on the shutter element 12 and hold the shutter element in the closed position, and when the shutter element 12 is arranged in the open position, it is deformed against the respective restoring force.

In a preferred embodiment of the invention, the control unit 22 applies a Zener voltage to the rotary solenoid 14 when closing the shutter element 12, i.e. when moving the shutter element 12 from the open into the closed position so that the shutter element 12 is closed faster.

Figure 4:
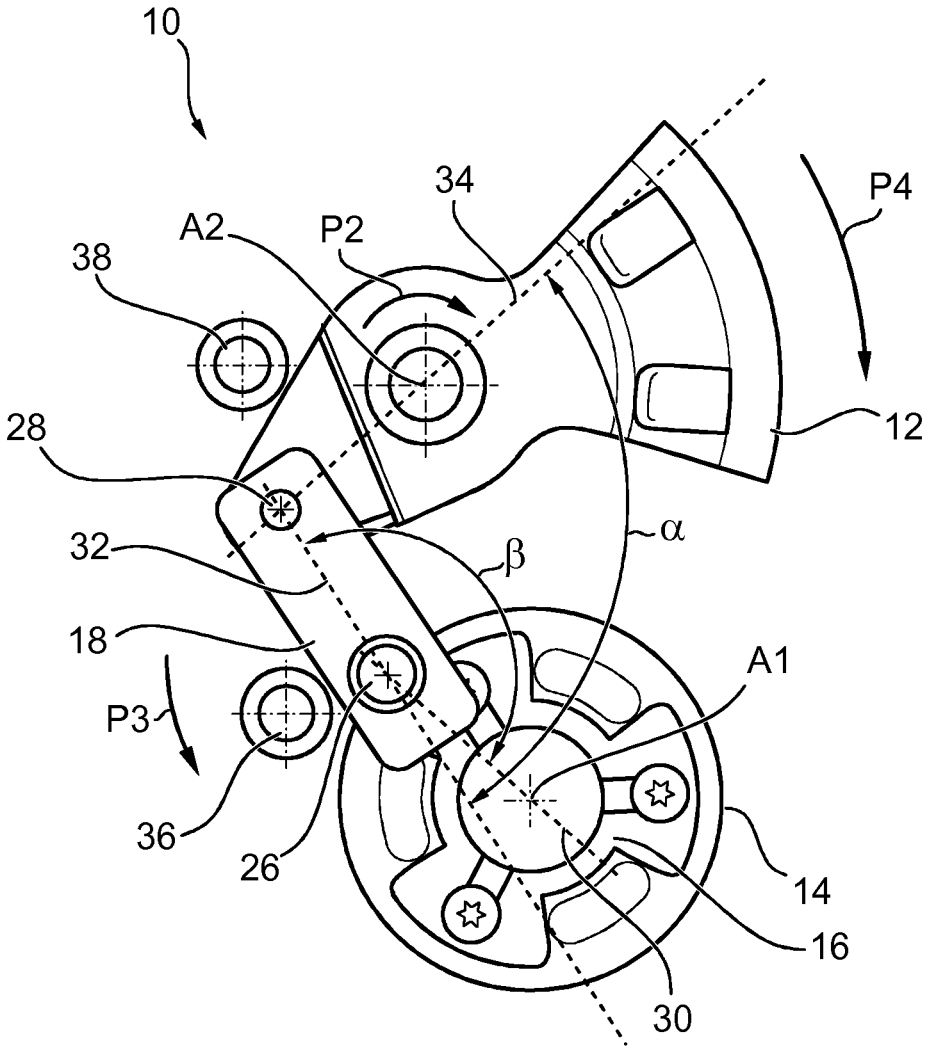
FIG. 4 is a further schematic illustration of the arrangement according to FIGS. 1 to 3 when the shutter element is in the closed position.

In FIG. 4, another side view of the arrangement 10 according to FIGS. 1 to 3 is illustrated. The shutter element 12 is arranged in the closed position and the armature 16 is arranged in the first position. In FIG. 4, three broken lines 30, 32, 34 are illustrated, the first broken line 30 being arranged such that it orthogonally intersects both the longitudinal axis A1 of the armature 16 and the center axis of the first screw 26. The second broken line 32 is arranged such that it orthogonally intersects both the longitudinal axis of the first screw 26 and the longitudinal axis of the second screw 28. The third broken line 34 orthogonally intersects both the longitudinal axis of the second screw 28 and the axis A2, about which the shutter element 12 can be pivoted.

The angle at which the second and the third broken line 32, 34 intersect, is identified in the following with $\alpha$. The angle at which the first broken line 30 and the second broken line 32 intersect one another, is identified with $\beta$. When the shutter element 12, as illustrated in FIG. 4, is arranged in the closed position, the armature 16, the connecting element 18 and the shutter element 12 are arranged with respect to one another such that the angle $\alpha$ has a value of greater than 90° and less than 180° and the angle $\beta$ has a value of less than 180° and greater than 0°.

Further, the arrangement 10 comprises two stop elements 36, 38, the first stop element 36 contacting the connecting element 18, and the second stop element 38 contacting the shutter element 12 when the shutter element 12 is arranged in the closed position. By means of the first stop element 36 an anticlockwise rotary motion of the connecting element 18 in the direction of the arrow P3 is prevented. By means of the second stop element 38 a clockwise rotation of the shutter element in the direction of the arrow P2 is prevented.

By selecting the angles $\alpha$ and $\beta$ as described above and by the two stop elements 36, 38 it is achieved that the arrangement 10 is automatically locked when the shutter element 12 is arranged in the closed position. Thus, an external opening of the shutter element 12 is prevented, as a result whereof attempts of manipulation are prevented.

By the automatic locking of the shutter element 12 as a result of the geometric arrangement of the shutter element 12, the armature 16 and the connecting element 18 relative to one another as well as the stop elements 36, 38, it is achieved that an additional locking mechanism can be dispensed with so that a simple and compact structure of the arrangement 10 is achieved.

The rotary solenoid 14 is in particular a DC rotary solenoid. As screws 26, 28 in particular shoulder screws are used.

In a preferred embodiment of the invention, at first the control unit 22 applies a constant DC output for a preset time interval to the rotary solenoid 14 during opening of the shutter element 12, i.e. when moving the shutter element 12 from the closed into the open position. This preset time interval has in particular a value between 70 ms and 90 ms, preferably of 80 ms. Within this time interval, the armature 16 of the rotary solenoid 14 is moved from the first position into the second position.

Here, at first only the connecting element 18 is moved and the shutter element 12 remains in the closed state. Only after the armature 16 has been rotated by a preset unlocking angle relative to the first position, the shutter element is moved in the direction of the arrow P4 from the closed position into the open position. This locking angle has in particular a value between 27° and 28°.

After the shutter element 12 has been moved into the open position, the control unit 22 controls the rotary solenoid 14 via a pulse width modulation (PWM) such that only as much current is applied to the rotary solenoid 14 that the magnetic field required for holding the shutter element 12 in the open position is generated. The pulse width modulation takes place in particular in a frequency range between 20 kHz and 30 kHz, preferably at a frequency of about 25 kHz, so that the noise caused by the pulse width modulation is not perceived by a human being.

Figure 5:
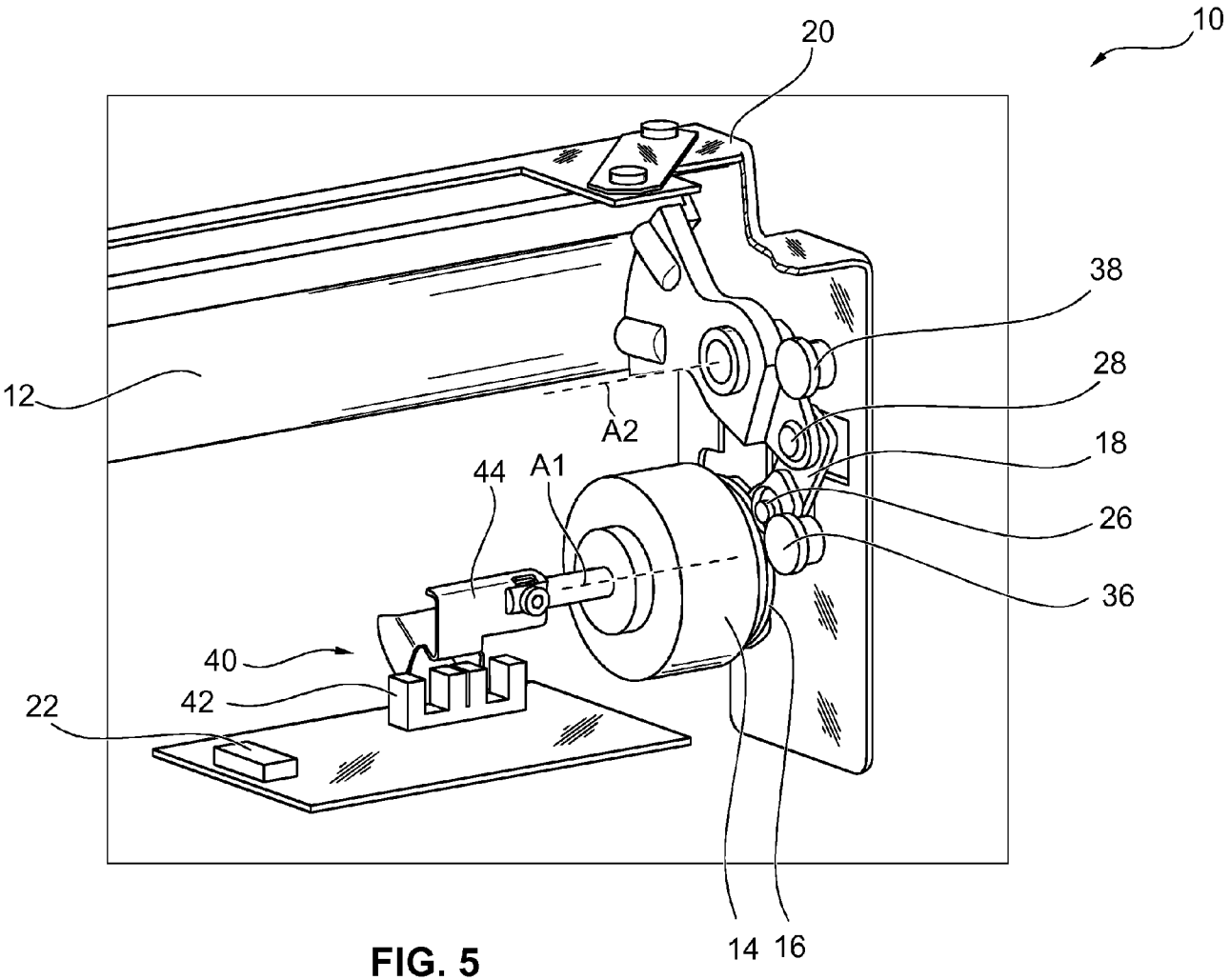
FIG. 5 is a schematic perspective illustration of the arrangement according to FIGS. 1 to 4 when the shutter element is in the closed position.
Figure 6:
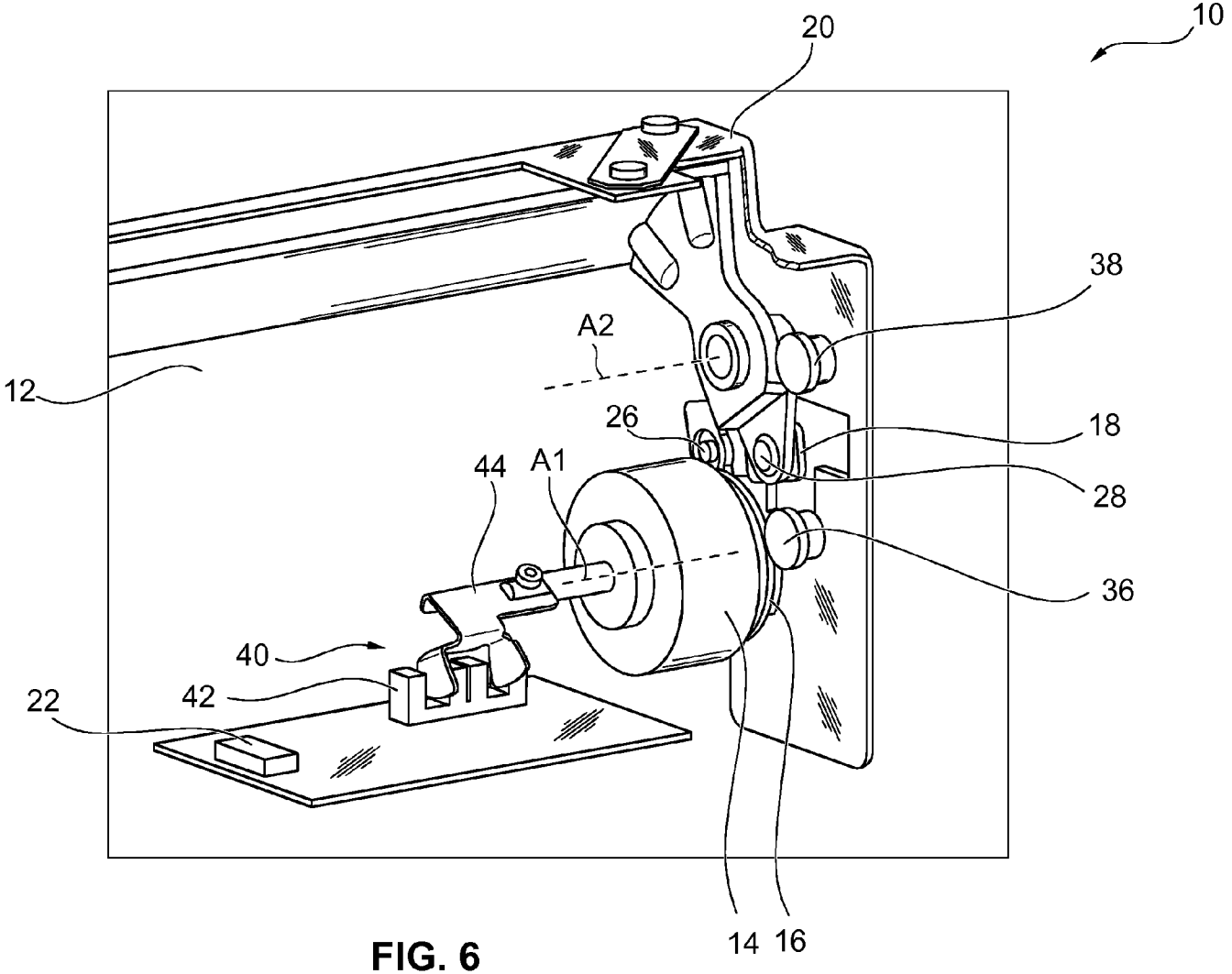
FIG. 6 is a schematic perspective illustration of the arrangement according to FIGS. 1 to 5 when the shutter element is in the open position.

In FIGS. 5 and 6 a schematic perspective illustration of the arrangement 10 is shown each time with a view to a sensor unit 40 for the detection of the position of the shutter element 12, in FIG. 5 the shutter element 12 being arranged in the closed position and in FIG. 6 the shutter element 12 being arranged in the open position.

The sensor unit 40 comprises a light barrier 42 and an interrupting element 44 which is fixed to the rotary solenoid 14. The interrupting element 44 is connected to the rotary solenoid 14 such that it performs the same rotary motion as the armature 16. Hereby it is achieved that the interrupting element 44 interrupts the light beam emitted by the light barrier 42 when the armature 16 is arranged in the second position and thus when the shutter element 12 is arranged in the open position, and that it does not interrupt the light beam when the armature 16 is arranged in the first position and thus when the shutter element 12 is arranged in the closed position. Thus, the position of the shutter element 12 can be determined in an easy manner.

In an alternative embodiment of the invention the interrupting element 44 does not interrupt the light beam of the light barrier 42 when the armature 16 is in the first position and that it does interrupt the light beam when the armature 16 is in the second position. Further, another sensor can also be alternatively used for the detection of the position of the shutter element 12. Likewise it is alternatively possible to completely dispense with a sensor unit 40 for the detection of the position of the shutter element 12.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. An arrangement for closing an opening for the output and input of notes, of a device for handling notes, comprising:

a shutter element pivotable about an axis;

a rotary solenoid having an armature, the armature is rotatable about an axis of the armature; and a connecting element through which the armature of the rotary solenoid is connected to the shutter element;

wherein:

in a first position of the armature, the shutter element is arranged in a closed position;

in a second position of the armature, the shutter element is arranged in an open position wherein when the armature rotates in an opening direction from the first position to the second position, the shutter element moves toward the open position;

a first end region of the connecting element is rotatably connected to the armature;

a second end region of the connecting element opposite to the first end region is rotatably connected to the shutter element;

the first end region is rotably connected to the armature via a first mounting element so as to be rotatable about a first axis of rotation spaced from the axis of the armature;

the second end region is connected to the shutter element via a second mounting element so as to be rotatable about a second axis of rotation spaced from the axis of the shutter element;

a first connecting line, which orthogonally intersects both the first axis of rotation and the axis of the armature, and a second connecting line, which orthogonally intersects both the first axis of rotation and the second axis of rotation, intersect one another at an angle (β) between 90° and 179° when the armature is arranged in the first position, which corresponds to the closed position of the shutter element;

a first stop element contacts the connecting element and prevents a rotary motion of the connecting element in a first direction of rotation when the armature is arranged in the first position, and a second stop element which contacts the shutter element and prevents a rotary motion of the shutter element in a second direction of rotation when the armature is arranged in the first position; and the first direction of rotation is opposite to the second direction of rotation and; wherein when a force acts on the shutter element to urge the shutter element from the closed position toward the open position, said force urges the armature to rotate in a direction opposite to said opening direction.

2. The arrangement according to claim 1, wherein, in the second position, the armature is rotated by an angle in the range between 60° and 70°, about its axis relative to the first position.

3. The arrangement according to claim 1, wherein the rotary solenoid moves the shutter element from the closed position into the open position when the armature is moved from the first position into the second position.

4. The arrangement according to claim 1, wherein the rotary solenoid is de-energized when the armature is arranged in the first position and is energized when the armature is arranged in the second position.

5. The arrangement according to claim 1, wherein the rotary solenoid comprises at least one elastic element which holds the armature in the first position and which is elastically deformed when the armature is arranged in the second position.

6. The arrangement according to claim 1, wherein the connecting element is a plate.

7. The arrangement according to claim 1, wherein the first axis of rotation coincides with a rotational axis of the first mounting element and the second axis of rotation coincides with a rotational axis of the second mounting element.

8. The arrangement according to claim 1, wherein a third connecting line, which orthogonally intersects both the second axis of rotation and the axis about which the shutter element is pivotable, and a second connecting line, which orthogonally intersects both the first axis of rotation and the second axis of rotation, intersect one another at an angle ($\alpha$) between 90° and 180° when the armature is arranged in the first position.

9. The arrangement according to claim 1, wherein a control unit is provided which controls application of electric current to the rotary solenoid.

10. The arrangement according to claim 9, wherein the control unit controls the current applied to the rotary solenoid by pulse width modulation.

* * * * *